US006864763B2

(12) United States Patent
Brown et al.

(10) Patent No.: US 6,864,763 B2
(45) Date of Patent: Mar. 8, 2005

(54) TUNABLE COUPLING IRIS AND METHOD

(75) Inventors: Jeffrey M. Brown, Windham, ME (US); Cole N. Plummer, South Casco, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/234,835

(22) Filed: Sep. 5, 2002

(65) Prior Publication Data

US 2004/0046623 A1 Mar. 11, 2004

(51) Int. Cl.[7] ..... H01P 3/12; H01P 7/06

(52) U.S. Cl. ..... 333/230; 333/212

(58) Field of Search ..... 333/230, 24 R, 333/207, 212, 252, 202, 209, 208, 224; 331/56, 96, 90, 117 D; 343/785, 791, 772; 505/210

(56) References Cited

U.S. PATENT DOCUMENTS 3,516,030 A * 6/1970 Brumbelow ..... 333/212
3,544,927 A * 12/1970 Elder et al. ..... 333/209
3,708,767 A * 1/1973 Moore ..... 333/24 R
3,811,101 A * 5/1974 Karp ..... 333/207
4,011,527 A * 3/1977 Havens ..... 331/117 D
4,028,651 A 6/1977 Leetman ..... 333/212
4,083,016 A * 4/1978 Zangrando et al. ..... 331/56
4,251,787 A 2/1981 Young et al. ..... 333/209
4,531,104 A * 7/1985 Schaeffer ..... 331/90
4,686,496 A * 8/1987 Syrett et al. ..... 333/202
4,766,398 A * 8/1988 Kiedrowski ..... 331/96
5,012,211 A * 4/1991 Young et al. ..... 333/212
5,252,984 A * 10/1993 Dorrie et al. ..... 343/791
5,585,331 A * 12/1996 Mansour et al. ..... 505/210
5,805,033 A 9/1998 Liang et al. ..... 333/202
5,886,594 A 3/1999 Guglielmi et al. ..... 333/208
5,936,493 A * 8/1999 Hulderman et al. ..... 333/252
5,936,589 A * 8/1999 Kawahata ..... 343/785
6,005,457 A 12/1999 Wu ..... 333/208
6,097,346 A * 8/2000 Fehrenbach et al. ..... 343/785
6,154,181 A 11/2000 Hu-Guo et al. ..... 343/772
6,232,852 B1 5/2001 Small et al. ..... 333/208
6,297,715 B1 * 10/2001 Fiedziuszko et al. ..... 333/209
6,384,699 B1 5/2002 Henningsson et al. ..... 333/224
6,392,509 B2 * 5/2002 Broad et al. ..... 333/212

* cited by examiner

*Primary Examiner*—Patrick Wamsley
(74) *Attorney, Agent, or Firm*—Baker & Hostetler LLP

(57) ABSTRACT

A plate has an iris defined by an aperture, and a rod extending radially outward from the iris through the plate. The rod is radially adjustable and a sleeve is disposed on the rod, for tuning the plate by slidably adjusting the rod radially.

21 Claims, 9 Drawing Sheets

TUNABLE COUPLING IRIS AND METHOD

FIELD OF THE INVENTION

The present invention relates generally to the field of tunable cavity filters and more particularly to coupling plates and methods used, for example, with tunable cavity filters in broadcasting and transmission of electromagnetic signals.

BACKGROUND OF THE INVENTION

In an effort to comply with upcoming Federal Communications Commission broadcast requirements, television stations across the United States are adding digital broadcasting capability while maintaining present analog broadcasting capability. The changeover from analog to digital is motivated at least in part by FCC requirements mandating that analog television broadcasts be phased out and replaced over time by all digital television broadcasts. The amount of time a station has to begin and comply with the changeover is dependent on a number of factors including the size of the television viewing market served by the station. Stations adding digital broadcast capability cannot simply reuse existing equipment in many instances due to more restrictive digital broadcasting parameters.

Broadcasting digital television signals, particularly digital UHF television signals, involves more stringent parameters than those involved with analog signal broadcasting. This is especially true with regard to the degree of frequency cutoff sharpness required at the upper and lower frequencies passed through a bandpass filter. The number of cavities in a bandpass filter are a factor in determining the sharpness of the frequency cutoff. A bandpass filter with several cavities will have a sharper cutoff at the upper and lower frequencies than a bandpass filter with fewer cavities. While a multiple cavity bandpass filter comprises a single component required for digital broadcasting, it can be a very expensive component.

Bandpass filters are very expensive due to current filter manufacturing methods and filter tuning methods. Coupling plates comprise a significant portion of the cost of a bandpass filter. Several coupling plates are used in a single cavity bandpass filter. Specifically, coupling plates are used to attach adjoining components to a filter such as a waveguide transmission feed line. Additionally, coupling plates are also used to attach multiple cavities of a filter together in the case of a multiple cavity bandpass filter. The coupling plate itself comprises an iris defining an aperture. The tuning of a bandpass filter is dependent upon the size of the iris in the coupling plate.

A bandpass filter must be tuned and adjusted prior to use for a given application. Current tuning methods involve individually tuning each iris coupling plate used in a filter by adjusting the size of the iris. Current manufacturing and assembly methods employ an iterative process that involves assembling the components of a filter, measuring the characteristics of the assembled filter, disassembling the components of the filter, adjusting the filter tuning by machining out the coupling plate iris, assembling the components of the filter and repeating the process. By virtue of the iterative tuning process, each coupling plate within the same filter has a unique iris aperture size thus limiting use of each coupling plate to a specific position in a specific filter configuration.

In addition to the long standing prior art coupling plate manufacturing problem requiring customization by individual machining of every iris coupling plate, prior art coupling plate tuning methods are also subject to a waste problem. The opening of an iris can only be made larger using prior art tuning and manufacturing methods involving machining out the iris. If an iris opening is made too large by machining it out, then another plate must be made, thus causing waste of material, as well as repeated effort to start the tuning process over again.

Another tuning method currently used involves adjusting the tuning of a filter using metal tuning components. The metal components are adjusted and then held in a fixed position with threads or a lockable sliding mechanism. Using metal tuning components, however, has several drawbacks.

Contact problems can be the biggest problem with using metal tuning components, and in some instances are destructive and quite costly. One type of contact problem is brought about by insufficient contact between tuning components and the filter. Insufficient contact can permit too much movement between tuning components and the filter. Another type of contact problem is brought about when the degree of contact between the filter and the tuning component does not permit enough or any movement between components and the filter.

Initially a contact problem causes local heating at the contacts. The accelerated heating in the apparatus may change the apparent tuning. The increased heat speeds up the rate of oxidation of metal components. Oxidation of metal components further exacerbates the initial contact problem and continues the problem cycle which will ultimately lead to the destruction of the contacts. If a filter using metal tuning components is employed in a high power application, such as digital UHF broadcasting, a slight variation in the apparent filter tuning may result in the buildup of enough heat to damage the filter.

Contact problems, in addition to adversely effecting the digital broadcast of the station in question, may interfere with other digital broadcasts. Due to stringent parameters involved with digital broadcasting, changes to the apparent tuning of a filter brought about by contact problems may interfere with the digital broadcast of neighboring television stations serving the same broadcasting market. Causing interference with other stations by broadcasting outside of the frequencies specified in a television station's broadcasting license may have adverse consequences with the FCC.

One approach to control problems is the use of silver plating to minimize corrosion and facilitate electrical conductivity. However, even with silver plating, metal tuning components may be susceptible to contact problems.

Thus, there is a need in the art for a novel coupling plate that is cost effective and can ultimately reduce the cost of bandpass filters required for applications such as digital television broadcasting. There is also a need in the art for a novel coupling plate that alleviates the contact problems associated with using metal tuning components. There is also a need for a novel coupling plate that is tunable without undesirable contact problems, and that does not require adjusting the size of the iris by machining it out.

SUMMARY OF THE INVENTION

Preferred embodiments of the present invention can solve the aforementioned manufacturing problems with tuning filters at least to some extent via a new and novel apparatus and method. Embodiments of the present invention can be used as a standard and interchangeable non-contact tunable iris coupling plate. In some embodiments, the size of the iris can be adjusted in two directions. Further, some embodiments of the present invention provide a method for assembling and tuning a filter that can avoid an iterative assembly process.

In accordance with one embodiment of the present invention, a tunable coupling apparatus may comprise a plate having an iris that defines an aperture, at least one rod that extends through the plate in a direction towards the aperture wherein the position of the rod is adjustable and a sleeve disposed between the rod and the plate and at least partially surrounding the rod. The sleeve spaces the rod from the plate. Preferably the rod is a dielectric rod.

In accordance with another embodiment of the present invention, a method for coupling components in a RF feed system may comprise providing a dielectric rod slidably supported in a passage in a plate, spacing the dielectric rod from the plate by a sleeve, transmitting a signal through an aperture in the plate, and tuning the plate by slidably adjusting the portion of the dielectric rod in the passage.

In accordance with another embodiment of the present invention, a system for coupling components for a RF feed may comprise a plate, means for defining an aperture in the plate, means for tuning the aperture having a dielectric rod that extends radially from the aperture, and means for preventing contact between the rod and the aperture.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the invention generally includes a plate with an aperture slot and at least one sleeve-lined passage that radially extends outwardly through the side of the plate starting from the plate aperture. The preferred embodiment also comprises a dielectric rod slidably disposed within the sleeve(s) lining the passage(s).

Figure 1:
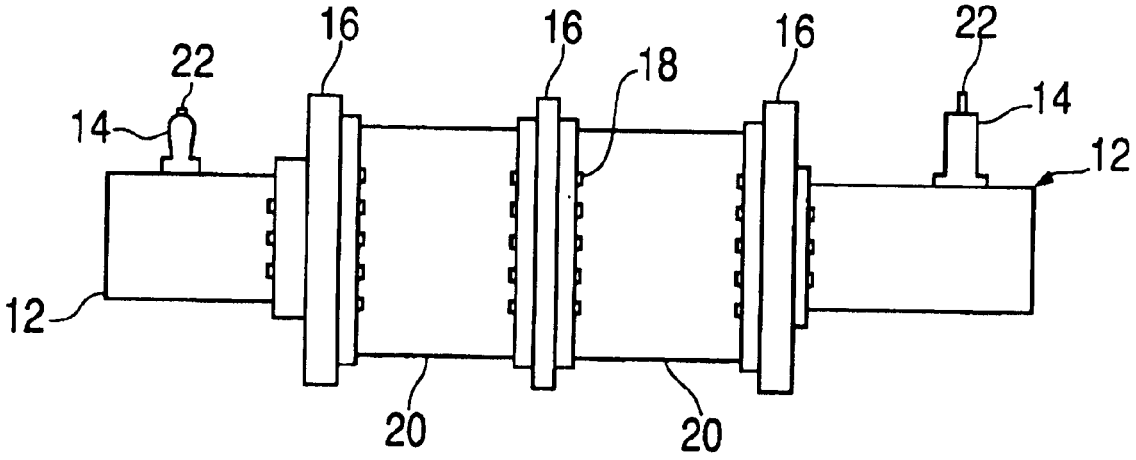
FIG. 1 is a side view of a bandpass filter.

Referring now to the figures, in FIG. 1 there is shown a side view of a filter 10 with waveguide transitions 12 and coaxial-to-waveguide transitions 14. A first wave guide transition 12 is attached to the filter 10 by a first coupling plate 16 and mounting bolts 18. The first coupling plate 16 is attached to a first end of a first cavity section 20 with mounting bolts 18. A second end of the first cavity section 20 is attached to a second coupling plate 16. The second coupling plate 16 is attached to a first end of a second cavity section 20. A second end of the second cavity section 20 is attached to a third coupling plate 16. The third coupling plate is attached to a second waveguide transition 12 with mounting bolts 18. The depicted filter 10 shows two cavity sections 20, but any number of cavity sections (including a single cavity) can be used.

Figure 2:
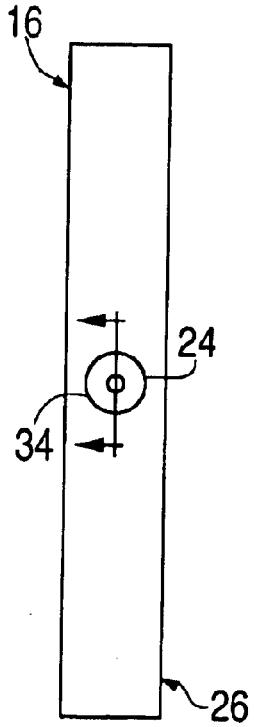
FIG. 2 is a front view of an iris coupling plate featuring a slotted aperture and cut-away view of a probe assembly.

In FIG. 2, there is shown a front view of a coupling plate 16 featuring a slotted iris aperture 28 with a cut-away view of a probe assembly 24. The probe assembly 24 is comprised of a rod-shaped probe 30 surrounded by a guide sleeve 32. Both the sleeve 32 and the probe 30 are disposed within a tuning passage 34. The tuning passage 34 extends radially from the slotted iris aperture 28 and through the side of the plate 26. The probe 30 is radially adjustable with respect to the aperture 28 by being slidably adjustable within the sleeve 32. The plate 26 also features mounting bolt holes 36 for attaching the coupling plate 16 to a component using bolts.

Preferably, the sleeve 32 is comprised of a non-conductive material that is thermally stable, such as Teflon®. In a preferred embodiment, the sleeve 32 at least partially surrounds the probe 30. For example, the sleeve 32 may be an elongated hollow cylinder. Other embodiments of the sleeve 32, may include an elongated C-shaped cross-section, a series of short rings or short C-shapes, or elongated strips of non-conductive material arranged longitudinally and at least partially surrounding the probe 30. The probe 30 is a dielectric rod and is comprised of a material with a low loss tangent and high dielectric constant, such as ceramic. Preferably, the probe 30 has a dielectric constant of about 10 and a loss tangent of about 0.0024 and may be of a uniform or non-uniform cross section or of a homogeneous or non-homogeneous material (shown, for example, in FIG 2). The plate 26 is comprised of aluminum in a preferred embodiment although other metals may be used. In a preferred embodiment, as shown, the plate 26 is a circular plate, however, the plate 26 can be any shape. A preferred embodiment of the plate 26 features bolt holes 36, although the plate may be attached to a component using any means for attaching or attaching method. In a preferred embodiment, the iris aperture 28 is slot shaped, however, the iris aperture may be defined by other shapes such as, but not limited to an ellipse, a rectangle or cross slots. The tuning passage 34 as pictured extends radially from the iris aperture 28, however, the tuning passage 34 may extend from the iris aperture in a non-radial fashion in other embodiments of the invention.

Figure 3:
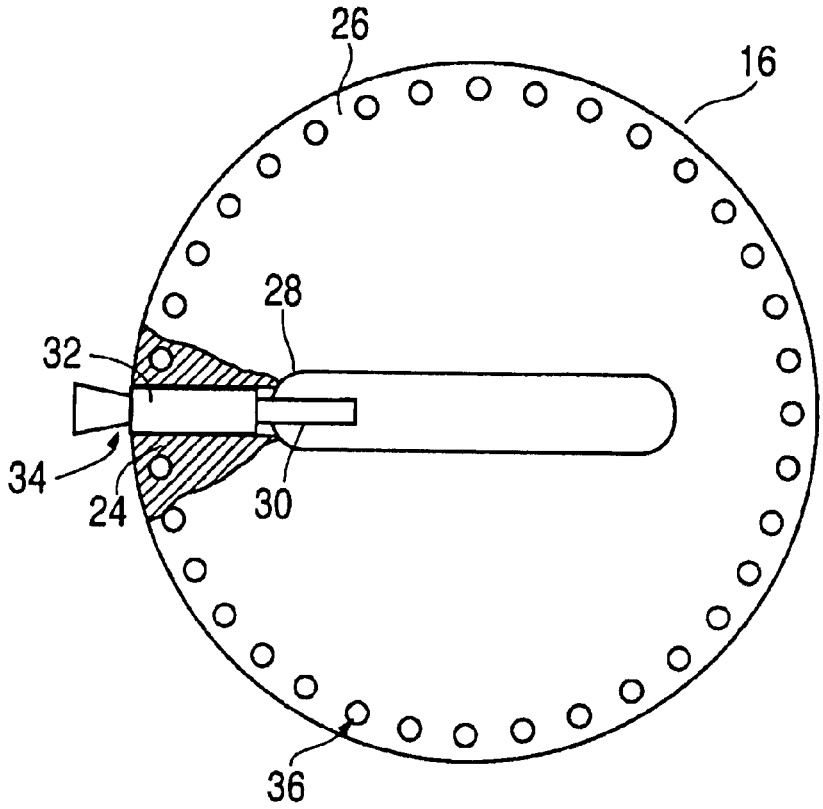
FIG. 3 is a side view of an iris coupling plate including a front view of a probe assembly.

In FIG. 3, there is shown a side view of the coupling plate 16 of FIG. 2. and a front view of the probe assembly 24. Both the probe 30 and the sleeve 32 are disposed within a tuning passage 34 that radially extends from the slotted iris aperture 28 through a side profile of the plate 26.

Figure 4:
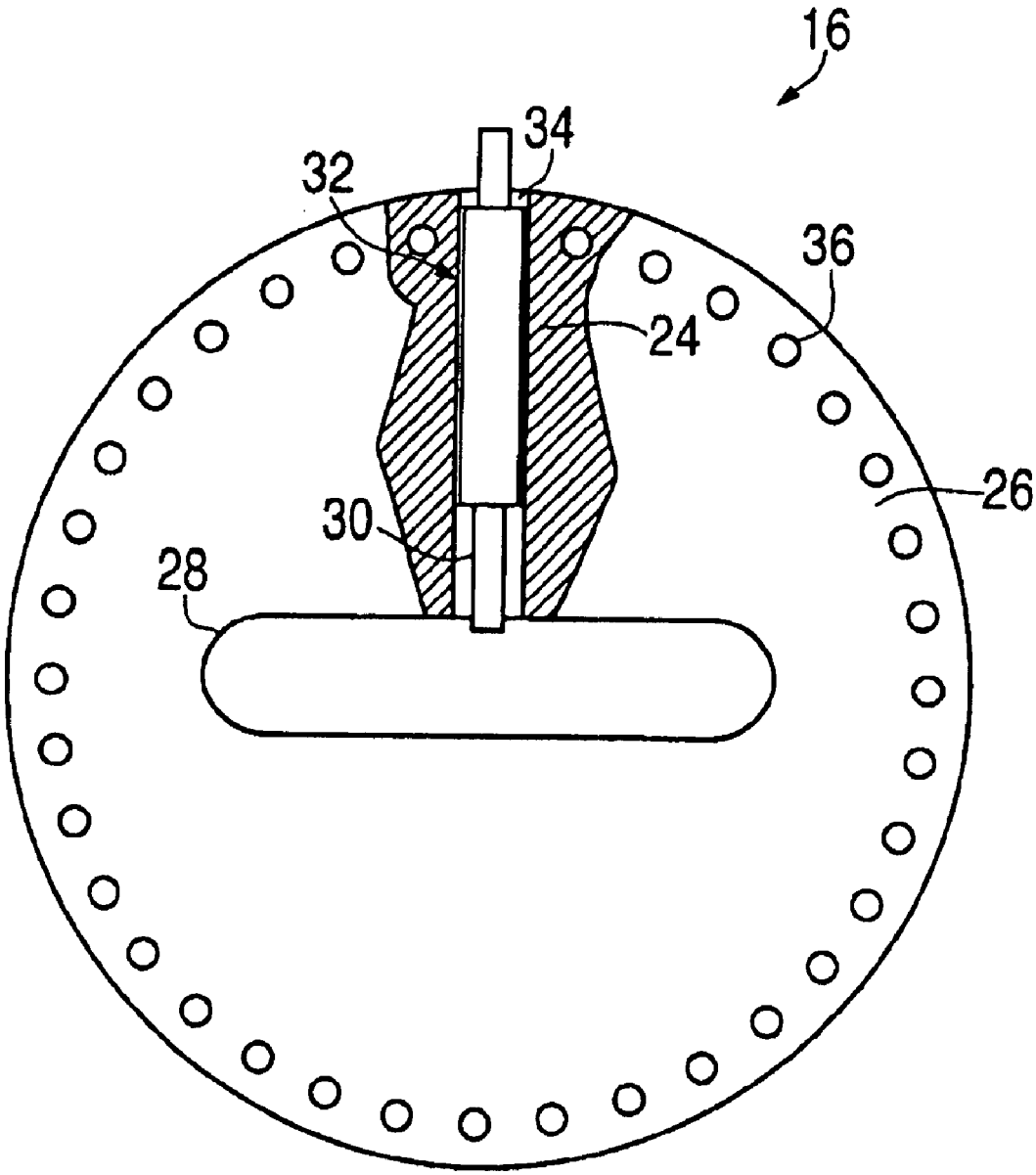
FIG. 4 is a front view of an alternate embodiment of an iris coupling plate with slotted aperture with perpendicular probe with a cut-away view of a probe assembly.

In FIG. 4, there is shown a front view of an alternate embodiment of a coupling plate 16 with a slotted iris aperture 28 and a cut-away view of a probe assembly 24 oriented perpendicularly with respect to the slotted iris aperture 28. The plate 26 also features mounting bolt holes 36 for attaching the coupling plate 16 to a component using bolts.

Figure 5:
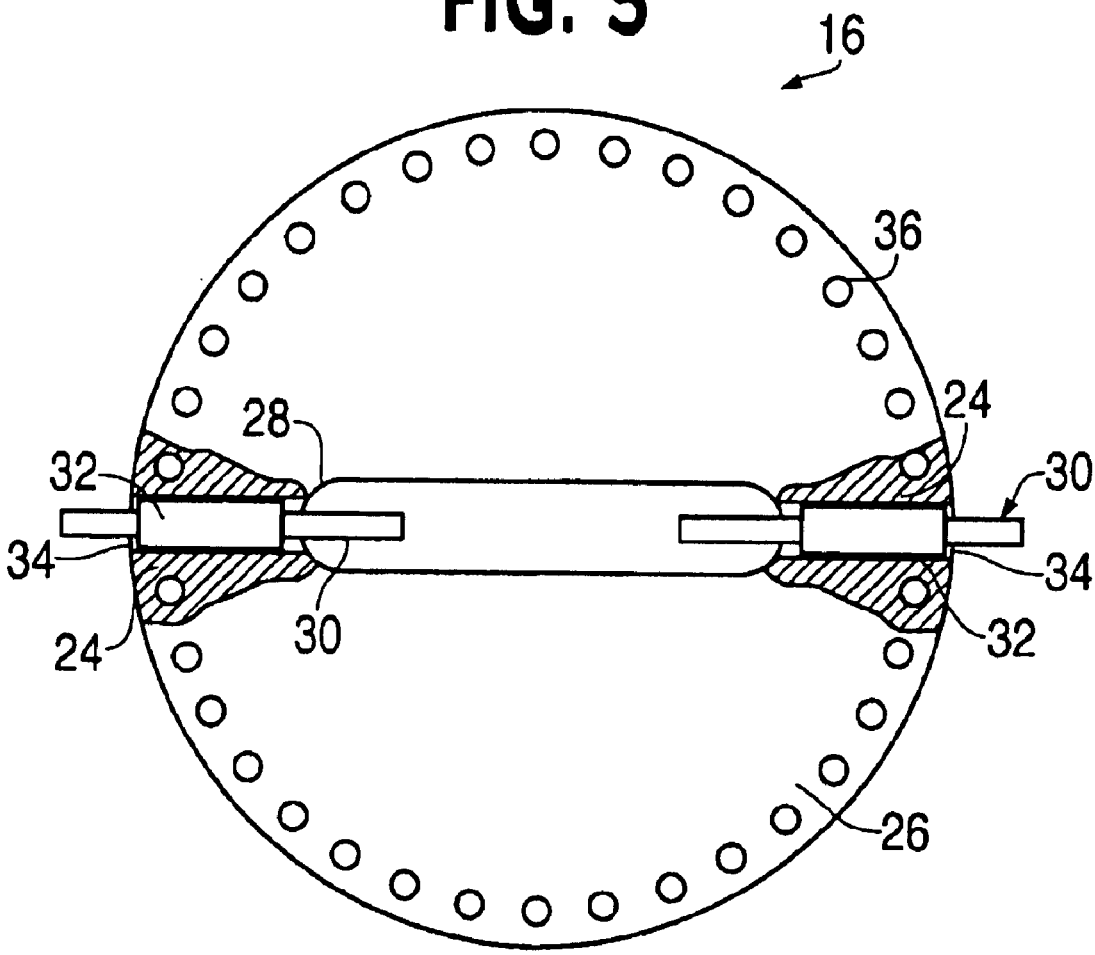
FIG. 5 is a front view of an alternate embodiment of an iris coupling plate with slotted aperture and multiple probes with a cut-away view of probe assemblies.

In FIG. 5, there is shown a front view of an alternate embodiment of a coupling plate 16 with a slotted iris aperture 28 and a cut-away view of multiple probe assemblies 24. Two probe assemblies 24 are shown in a parallel configuration with respect to the direction of the slotted iris aperture 28 and in alignment with respect to each other. The plate 26 also features mounting bolt holes 36 for attaching the coupling plate 16 to a component using bolts.

Figure 6:
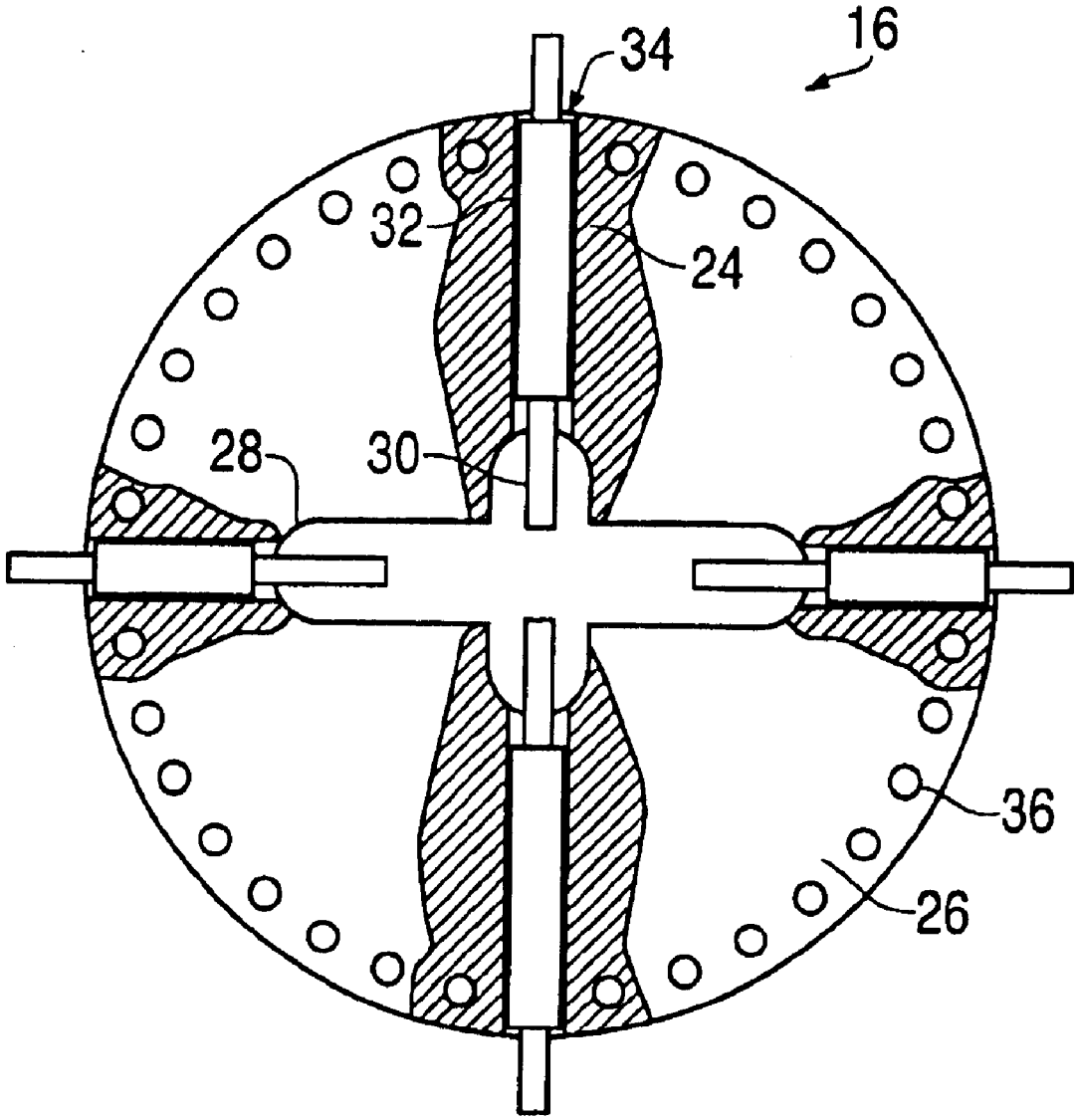
FIG. 6 is a front view of an alternate embodiment of an iris coupling plate with cross slotted aperture and multiple probes with a cut-away view of probe assemblies.

In FIG. 6, there is shown a front view of an alternate embodiment of a coupling plate 16 with a cross slotted iris aperture 28 and a cut-away view of multiple probe assemblies 24. The cross slotted iris aperture 28 features two perpendicular slots. Four probe assemblies 24 are shown in a configuration in which each probe assembly is both perpendicular to two other probe assemblies and in alignment with one other probe assembly. The plate 26 also features mounting bolt holes 36 for attaching the coupling plate 16 to a component using bolts.

Figure 7:
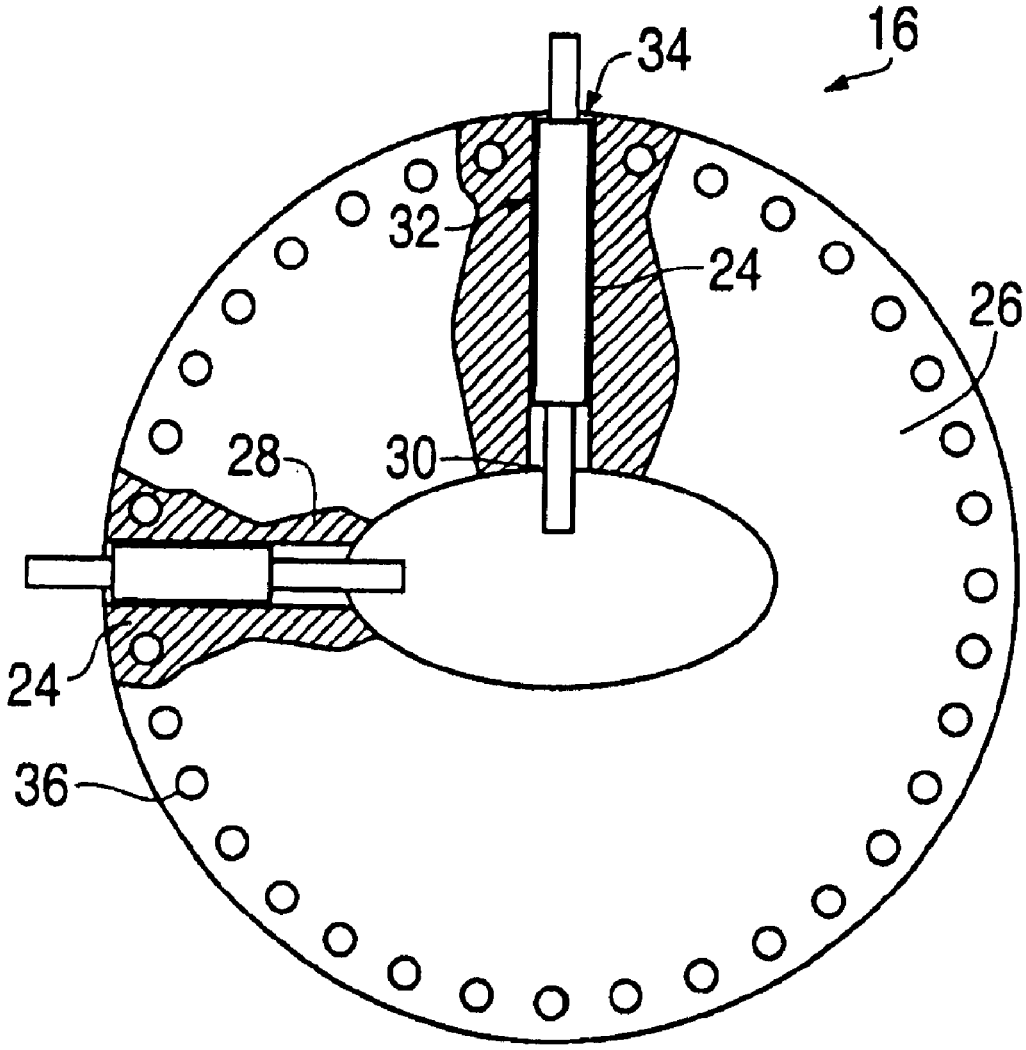
FIG. 7 is a front view of an alternate embodiment of an iris coupling plate with elliptical aperture and multiple probes with a cut-away view of probe assemblies.

In FIG. 7, there is shown a front view of an alternate embodiment of a coupling plate 16 with an elliptical iris aperture 28 and a cut-away view of multiple probe assemblies 24. The probe assemblies 24 are shown in a configuration in which a first probe assembly is perpendicular to a second probe assembly. The plate 26 also features mounting bolt holes 36 for attaching the coupling plate 16 to a component using bolts.

Figure 8:
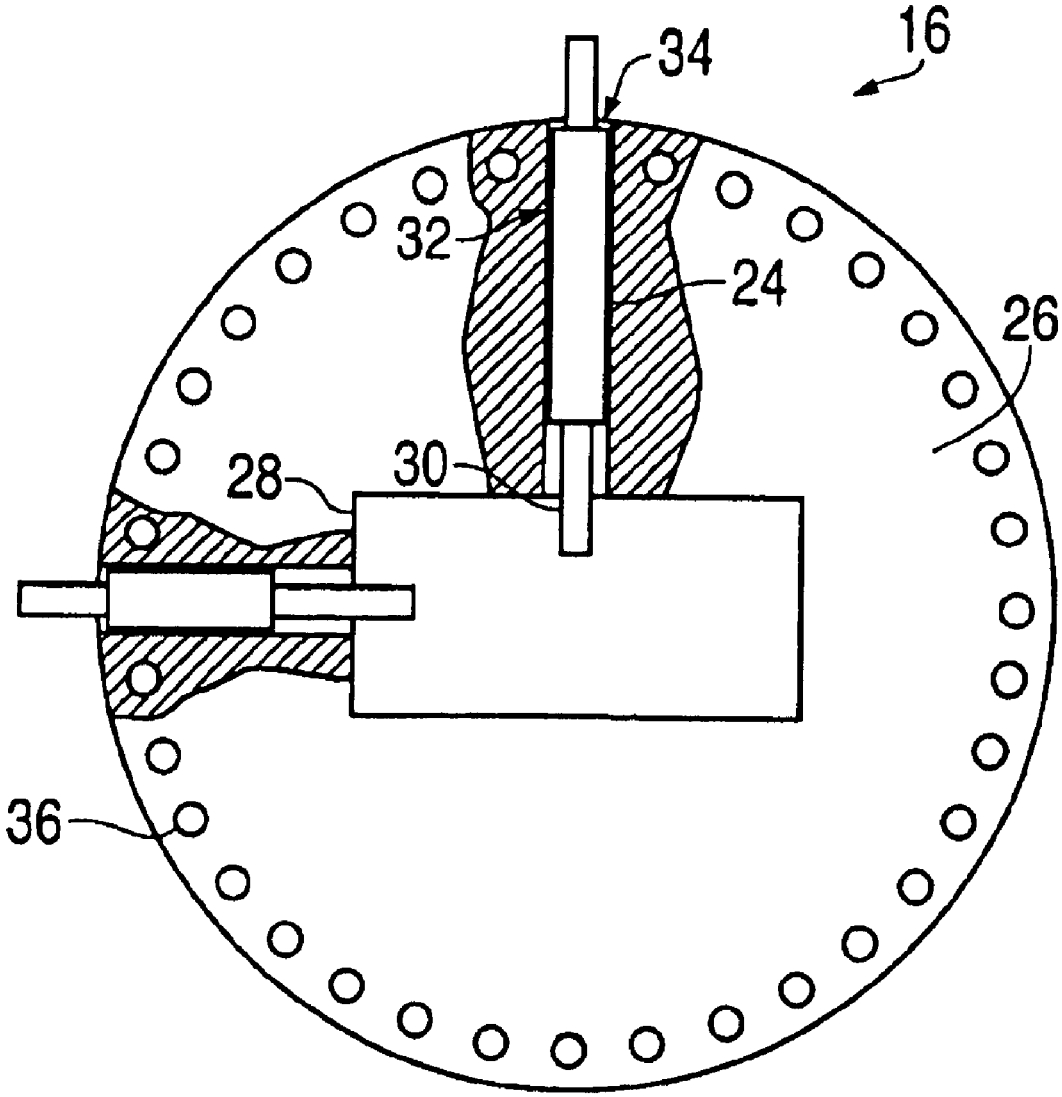
FIG. 8 is a front view of an alternate embodiment of an iris coupling plate with rectangular aperture and multiple probes with a cut-away view of probe assemblies.

In FIG. 8, there is shown a front view of an alternate embodiment of a coupling plate 16 with a rectangular iris aperture 28 and a cut-away view of multiple probe assemblies 24. The probe assemblies 24 are shown in a configuration in which a first probe assembly is perpendicular to a second probe assembly. The plate 26 also features mounting bolt holes 36 for attaching the coupling plate 16 to a component using bolts.

Figure 9:
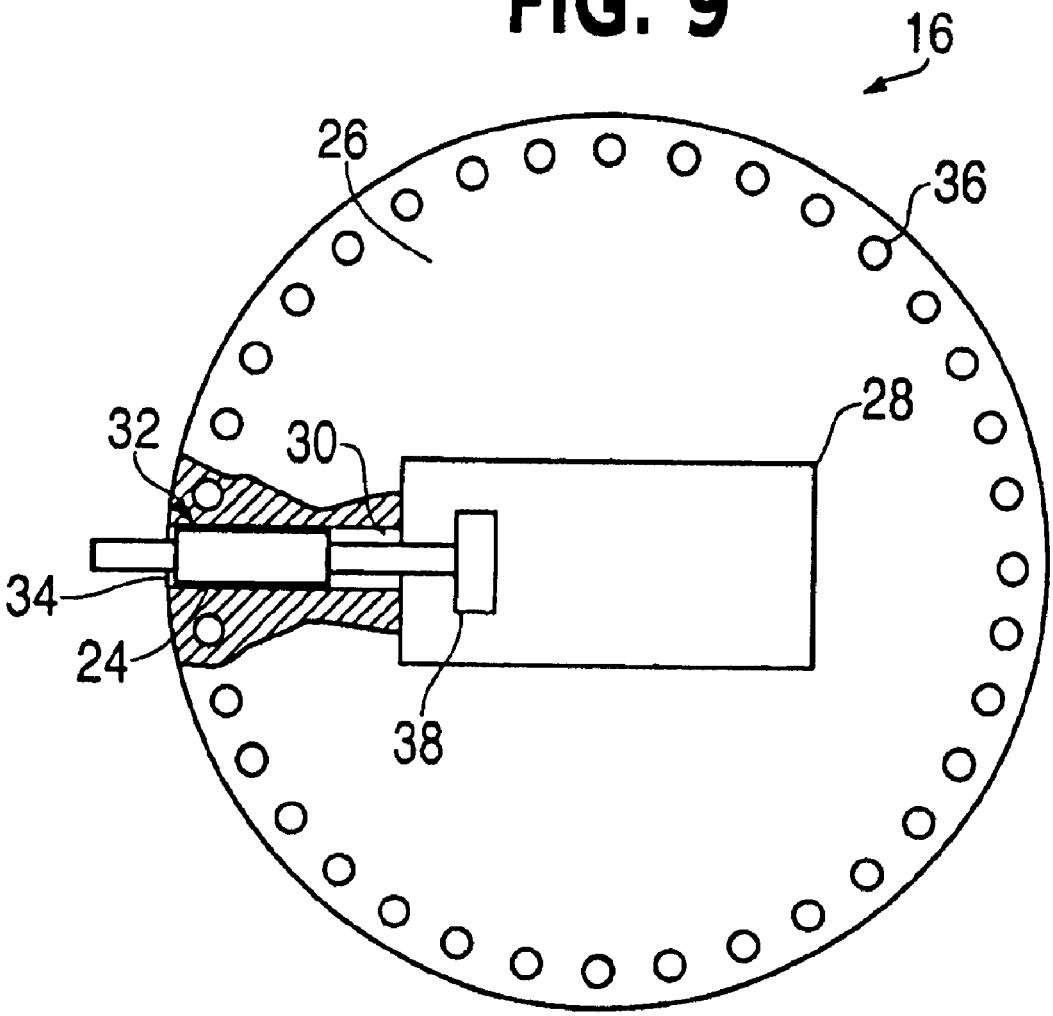
FIG. 9 is a front view of an iris coupling plate with a rectangular aperture and an alternate embodiment of a probe featuring additional dielectric area extending into the aperture with a cut-away view of a probe assembly.

In FIG. 9, there is shown a front view of an alternate embodiment of a coupling plate 16 with a rectangular iris aperture 28 and a probe 30 with a dielectric member 38 attached to thereto. FIG. 9 also depicts a cut-away view of the probe assembly 24. The dielectric member 38 is attached to the end of the probe 30 that extends into the rectangular iris aperture 28. The plate 26 also features mounting bolt holes 36 for attaching the coupling plate 16 to a component using bolts.

Figure 10:
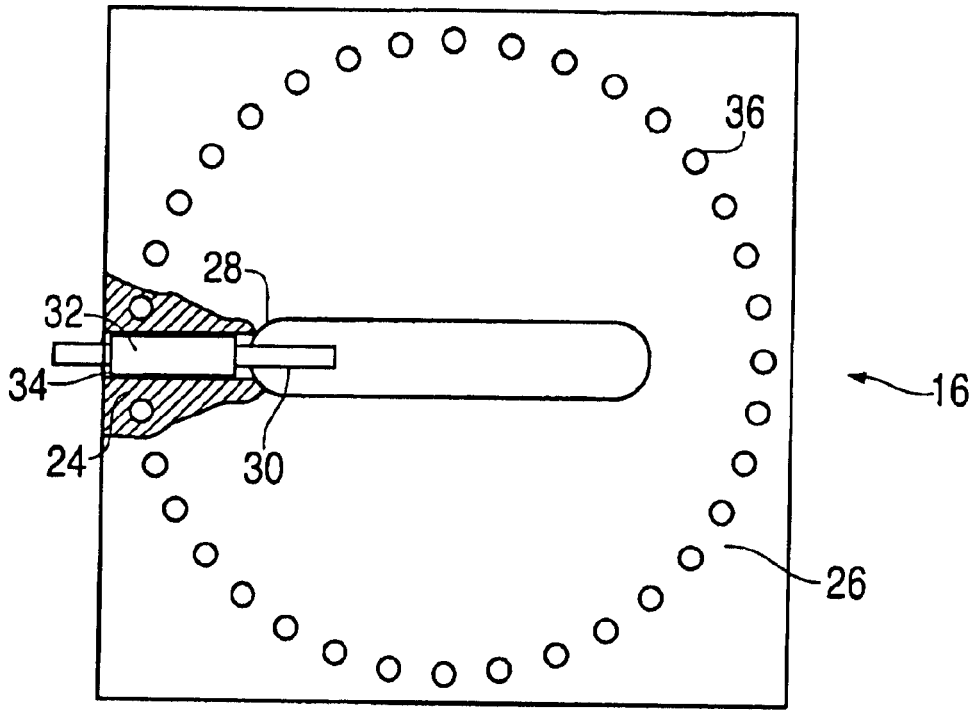
FIG. 10 is a front view of an alternate embodiment of an iris coupling plate including mounting holes for a waveguide transmission feed line.

In FIG. 10, there is shown a front view of an alternate embodiment of a coupling plate 16 with mounting bolt holes 36 corresponding to the mounting holes of a waveguide transmission feed line. The plate 16 also features a slotted iris aperture 28 and a cut-away view of a probe assembly 24. Additionally the plate 26 features mounting bolt holes 36 for attaching the coupling plate 16 to a component using bolts.

Figure 11:
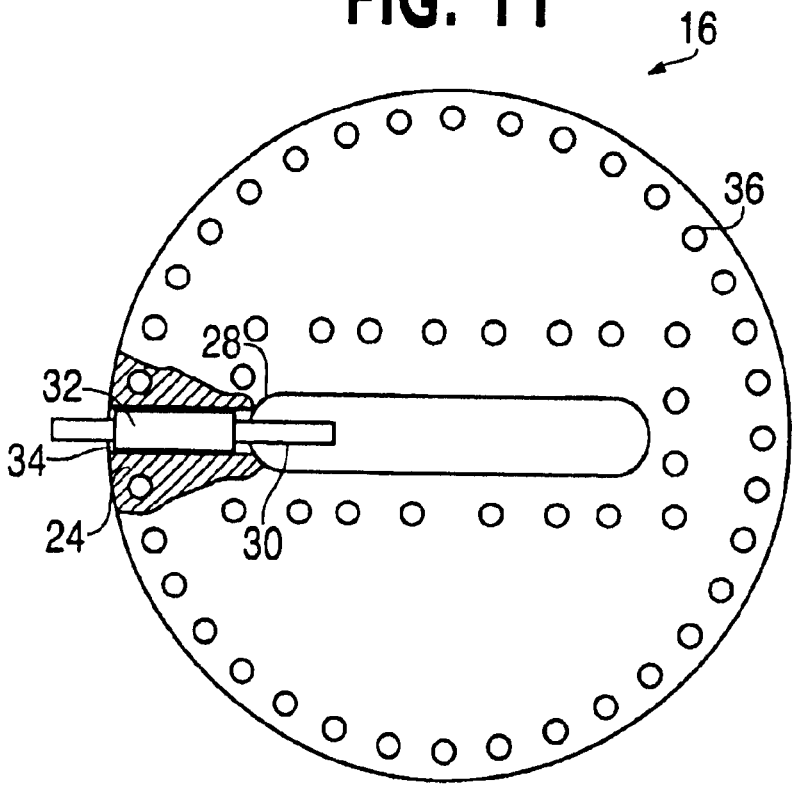
FIG. 11 is a front view of an alternate embodiment of an iris coupling plate with a rectangular plate.

In FIG. 11, there is shown a front view of an alternate embodiment of a coupling plate 16 with a plate 26 in the shape of a rectangle. The plate 16 also features a slotted iris aperture 28 and a cut-away view of a probe assembly 24. The plate 26 also features mounting bolt holes 36 for attaching the coupling plate 16 to a component using bolts.

In operation, to assemble a tunable filter according to one of the preferred embodiments, the user begins by attaching a first waveguide transition 12 to a first plate 16. The first plate 16 is attached to a first end of a first cavity section 20. A second end of the first cavity section 20 is attached to a second plate 16 which is attached to a first end of a second cavity section 20 and a second end of the second cavity section 20 is attached to a third plate 16. The third plate 16 is attached to a second waveguide transition 12. A test signal is transmitted into the first waveguide transition 12 and through the filter 10. An analyzer is connected to the second waveguide transition 12 to analyze the test signal after it has passed through the filter. Next, the user tunes the first plate 16 by slidably adjusting a probe 30 radially by moving the probe 30 inside the passage 34 so that one end of the probe 30 protrudes into an iris aperture 28 until the first plate is tuned appropriately. The user repeats this process for the second and third plates 16 until the filter 10 has been tuned appropriately. The user then fixes the position of the probes 30 once proper adjustment has been achieved. In some embodiments, the naturally occurring friction between the probe 30 and its surrounding sleeve 32 may be sufficient to retain the probe 30 in the desired tuned position. In other embodiments it may be desirable to provide a fixing apparatus such as a fixing material, plug, or a fixing lock mechanism. Also, the sleeve 32 may tend to stay fixed in the passage 34 while the probe 30 is moved in the passage 34. Alternatively, the sleeve 32 may be adhered or tend to adhere to the outside of the probe 30, and the sleeve 32 and probe 30 may be moved together in the passage 34.

Additionally the apparatus according to the present invention features a sleeve 32 that does not permit contact between the probe 30 and the plate 16. As such the tuning components of the present invention are non-contact tuning components that are at least less susceptible or not susceptible to the problems caused by insufficient contact or by too much contact between tuning components.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A tunable coupling apparatus comprising:

a plate having an iris that defines an aperture;

at least one rod comprised of a dielectric material extending through said plate in a direction toward said aperture, wherein the position of said rod is adjustable; and a guide disposed between said rod and said plate, wherein said guide spaces said rod from said plate.

2. The apparatus of claim 1, wherein said plate has a passage and said rod extends at least partially through said passage.

3. The apparatus of claim 2, wherein said passage extends radially through said plate.

4. The apparatus of claim 2, wherein said guide is fixed on said passage.

5. The apparatus of claim 1, wherein said guide is a sleeve and said sleeve at least partially surrounds said rod.

6. The apparatus of claim 1, wherein said rod is completely comprised of dielectric material.

7. The apparatus of claim 1, wherein said rod is comprised of a material with a dielectric constant of about 10 and a loss tangent of about 0.0024.

8. The apparatus of claim 1, wherein said rod is comprised of ceramic.

9. The apparatus of claim 1, wherein said guide is comprised of a material that is thermally stable and non-conductive.

10. The apparatus of claim 1, wherein said guide is comprised of Teflon®.

11. The apparatus of claim 1, wherein the shape of said aperture defining said iris is one of a triangle, ellipse, slot, rectangle, circle, and cross-slot.

12. The apparatus of claim 1, wherein said rod further comprises a first end and a second end, and said first end protrudes into said iris and has a tip member attached to said first end, said tip member having a different cross sectional area than said second end.

13. The apparatus of claim 1, wherein said rod further comprises a first end and a second end, and said first end protrudes into said iris and has a tip member attached to said first end, said tip member comprised of a different material than said second end.

14. The apparatus of claim 1, wherein said plate is a disk.

15. The apparatus of claim 1, wherein said plate has an outer periphery region and further comprises a plurality of mounting apertures spaced along said periphery region.

16. A method for coupling components in a RF feed system comprising:

providing a dielectric rod radially and slidably supported in a passage in a plate;

spacing said dielectric rod from said plate by a guide;

transmitting a signal through an aperture in said plate; and tuning said plate by slidably adjusting the portion of said dielectric rod in the passage.

17. The method of 16 further comprising:

attaching a component to said plate and passing a signal to or from the component through said aperture in the plate.

18. The method of claim 16, further comprising:

fixing the position of said rod after the adjusting step is completed.

19. A system for coupling components for a RF feed comprising:

a plate;

means for defining an aperture in said plate;

means for tuning said aperture having a dielectric rod that extends radially within said aperture; and means for preventing contact between said rod and said aperture.

20. A system according to claim 19, where said contact preventing means is a sleeve.

21. A system according to claim 19, further comprising means for fixing the position of said rod.

* * * * *